US006570349B2

(12) United States Patent
Kimiya et al.

(10) Patent No.: US 6,570,349 B2
(45) Date of Patent: May 27, 2003

(54) CATHODE-RAY TUBE APPARATUS

(75) Inventors: Junichi Kimiya, Kumagaya (JP); Syunji Ookubo, Kumagaya (JP); Takahiro Hasegawa, Gyoda (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/033,779

(22) Filed: Jan. 3, 2002

(65) Prior Publication Data

US 2002/0089295 A1 Jul. 11, 2002

(30) Foreign Application Priority Data

| | | |
|---|---|---|
| Jan. 9, 2001 | (JP) | 2001-001451 |
| Nov. 8, 2001 | (JP) | 2001-343575 |
| Dec. 27, 2001 | (JP) | 2001-395846 |
| Dec. 27, 2001 | (JP) | 2001-395847 |

(51) Int. Cl.[7] ..... G09G 1/04; H01J 29/50

(52) U.S. Cl. ..... 315/382; 315/370; 315/364; 315/399; 313/414; 313/428; 313/413

(58) Field of Search ..... 315/382, 382.1, 315/364, 368.16, 399, 370, 15, 17; 313/414, 412, 413, 415, 449, 428

(56) References Cited

U.S. PATENT DOCUMENTS

| | | | | |
|---|---|---|---|---|
| 5,449,983 A | * | 9/1995 | Sugawara et al. | 315/382 |
| 5,519,290 A | * | 5/1996 | Sugawara et al. | 315/382.1 |
| 6,339,293 B1 | * | 1/2002 | Kimiya et al. | 315/15 |

FOREIGN PATENT DOCUMENTS

| | | |
|---|---|---|
| JP | 61-99249 | 5/1986 |
| JP | 3-93135 | 4/1991 |
| JP | 9-219156 | 8/1997 |

* cited by examiner

*Primary Examiner*—Don Wong
*Assistant Examiner*—Tuyet T. Vo
(74) *Attorney, Agent, or Firm*—Oblon, Spivak, McClelland, Maier & Neustadt, P.C.

(57) ABSTRACT

A second grid is supplied with a low potential acceleration voltage. A fourth grid and a sixth grid are supplied with a first focus voltage. A third grid and a seventh grid are supplied with a dynamic focus voltage (Vf2+Vd). A prefocus lens having a horizontal and vertical focusing function is formed between the second grid and the third grid. An asymmetrical lens section having a horizontal diverging function and a vertical focusing function is formed between the third grid and the fourth grid. The prefocus lens and the asymmetrical lens section are electrostatically coupled.

23 Claims, 12 Drawing Sheets

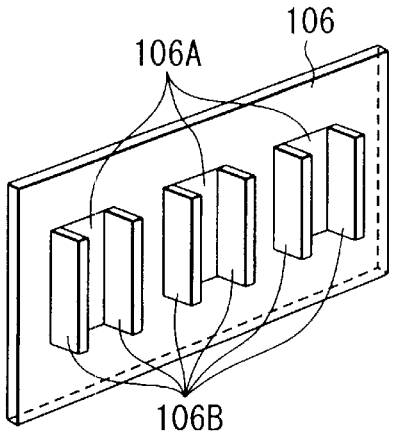
FIG. 12A
(PRIOR ART)
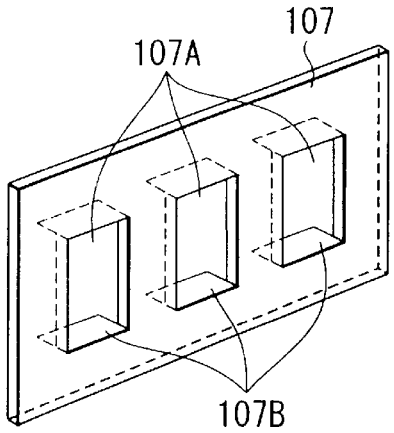
FIG. 12B
(PRIOR ART)
FIG. 13A
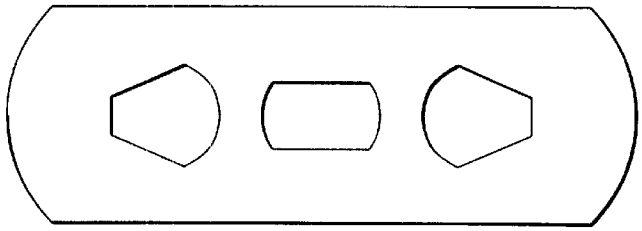
FIG. 13B
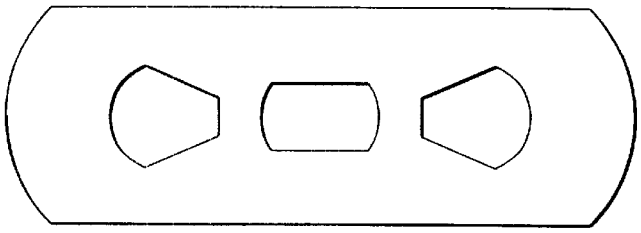

CATHODE-RAY TUBE APPARATUS

CROSS-REFERENCE TO RELATED APPLICATIONS

This application is based upon and claims the benefit of priority from the prior Japanese Patent Applications No. 2001-001451, filed Jan. 9, 2001; No. 2001-343575, filed Nov. 8, 2001; No. 2001-395846, filed Dec. 27, 2001; and No. 2001-395847, filed Dec. 27, 2001, the entire contents of all of which are incorporated herein by reference.

BACKGROUND OF THE INVENTION

1. Field of the Invention

The present invention relates generally to a cathode-ray tube (CRT) apparatus, and more particularly to a cathode-ray tube apparatus with an electron gun assembly capable of effecting dynamic astigmatism compensation.

2. Description of the Related Art

In general, a color cathode-ray tube apparatus comprises an in-line electron gun assembly, which emits three electron beams, and a deflection yoke which produces deflection magnetic fields for deflecting the three electron beams emitted from the electron gun assembly. Specifically, the deflection yoke produces non-uniform magnetic fields comprising a pincushion-shaped horizontal deflection magnetic field 10, as shown in FIG. 9A, and a barrel-shaped vertical deflection magnetic field.

An electron beam 6, which has passed through the non-uniform magnetic fields, suffers a deflection aberration, i.e. an astigmatism due to the deflection magnetic fields. Specifically, the electron beam 6 traveling toward a peripheral portion of a phosphor screen receives a force 11V which causes the electron beam 6 to be vertically over-focused due to deflection aberration. As is shown in FIG. 9B, a beam spot on the peripheral portion of the phosphor screen is deformed to include a vertically spread blur 12 and a horizontally spread core 13. The deflection aberration suffered by the electron beam increases as the size of the tube increases and the deflection angle increases. The deformation of the beam spot will considerably degrade the resolution at the peripheral portion of the phosphor screen.

Jpn. Pat. Appln. KOKAI Publication No. 61-99249 discloses electron gun assemblies as means for improving the degradation in resolution due to deflection aberration. Each of these electron gun assemblies has a common basic structure, as shown in FIG. 10A, which comprises first to fifth grids. An electron beam generating section GE, a quadrupole lens QL and an ultimate main lens EL are formed in the direction of travel of electron beams. The quadrupole lens QL is formed by providing each of the opposing faces of adjacent electrodes with three non-axially symmetric electron beam passage holes (for example, three horizontally elongated electron beam passage holes are provided in one electrode and three vertically elongated electron beam passage holes are provided in the other electrode, as shown in FIGS. 10B and 10C).

In this electron gun assembly, the lens powers of the quadrupole lens QL and ultimate main lens EL are varied in synchronism with a variation of deflection magnetic fields. Thereby, the deflection aberration suffered by the electron beam deflected onto the peripheral portion of the phosphor screen is reduced, and the deformation of the beam spot is improved.

In this type of electron gun assembly, however, when an electron beam is deflected onto a peripheral portion on the phosphor screen, the effect of deflection aberration is very great. Thus, even if blur of the beam spot is eliminated, horizontal deformation cannot fully be corrected.

Jpn. Pat. Appln. KOKAI Publication No. 3-93135 discloses an electron gun assembly with a double-quadrupole lens structure as another means for improving the degradation in resolution due to deflection aberration. In this electron gun assembly, as shown in FIGS. 11A and 11B, two quadrupole lenses with different polarities are formed on the cathode side of a main lens. These two quadrupole lenses are operated in synchronism with deflection magnetic fields.

In this electron gun assembly, as shown in FIGS. 11A and 11B, the angle of incidence of an electron beam on the phosphor screen 3 is made substantially equal in horizontal and vertical directions when the electron beam is focused on a central portion of the phosphor screen (a non-deflection mode indicated by a solid line) and when the electron beam is deflected on a peripheral portion of the phosphor screen (a deflection mode indicated by a broken line). Thereby, a horizontal deformation of the beam spot on the peripheral portion of the phosphor screen is improved, as shown in FIG. 11C.

However, if the above-described double-quadrupole lens structure is employed, the front-side quadrupole lens situated on the cathode side vertically focuses the electron beam and horizontally diverges the electron beam, as this lens is operated by produced deflection magnetic fields. As a result, the horizontal dimension of the electron beam incident on the main lens increases.

Consequently, part of the electron beam passes through a region that is horizontally away from the center axis of the main lens, and is greatly affected by spherical aberration of the main lens. Specifically, the beam spot on the peripheral portion of the phosphor screen is shaped to have a horizontal halo portion.

In order to eliminate the effect of the horizontal spherical aberration of the main lens due to the front-stage quadrupole lens, it is necessary to limit the divergence angle of the electron beam to such a degree that the beam suffers no effect of lens aberration in accordance with the lens aperture of the main lens when the quadrupole lens is operated.

Assume that when the electron beam is to be focused on the peripheral portion of the phosphor screen, the horizontal divergence angle of the electron beam incident on the main lens is set at a just divergence angle at which the beam suffers no effect of an aberration component of the main lens. In this case, the front-stage quadrupole lens operates, by its inherent behavior, to increase the horizontal divergence angle of the electron beam when the beam is deflected from the center to the peripheral area of the phosphor screen. As a result, the horizontal divergence angle of the electron beam in the non-deflection mode becomes smaller than that in the deflection mode. Accordingly, the horizontal magnification of the total lens action of this electron gun in the non-deflection mode becomes greater than that in the deflection mode, and the horizontal dimension of the beam spot on the center area of the phosphor screen increases.

On the other hand, assume that when the electron beam is to be focused on the center portion of the phosphor screen, the horizontal divergence angle of the electron beam incident on the main lens is set at a just divergence angle at which the beam suffers no effect of an aberration component of the main lens. In this case, the horizontal divergence angle of the electron beam in the deflection mode gradually increases and gradually suffers the effect of the aberration component of the main lens. As a result, the beam spot on the peripheral portion of the phosphor screen is shaped to have a horizontal halo portion.

If the horizontal divergence angle is affected by the front-stage quadrupole lens, the horizontal dimension of the beam spot increases at either a peripheral portion or a central portion of the phosphor screen.

In addition, the structure wherein double-quadrupole lenses with different polarities are disposed on the cathode side of the main lens has a problem that a dynamic focus voltage is increased. If two quadrupole lenses with different polarities are created at the same time, the electron gun assembly operates as if a cylindrical lens were created between the two quadrupole lenses. As a result, an imaginary object point for the main lens is shifted backward from the main lens side to the cathode side.

Moreover, in this structure comprising the double-quadrupole lenses with different polarities, the two quadrupole lenses act so as to mutually cancel their lens powers. For this reason, the lens sensitivity of each quadrupole lens needs to be increased. For example, as shown in FIGS. 12A and 12B, the lens sensitivity can be increased by creating a quadrupole lens between electrodes each having upright projection portions extending in the direction of travel of the electron beam. However, with this electrode structure, a variance tends to occur in precision of positions of the upright projection portions and a stable operation is unexpectable.

As has been described above, with the cathode-ray tube apparatus having the conventional structure, the deformation of the beam spot on the peripheral portion of the phosphor screen is not fully corrected and good focus characteristics cannot be obtained over the entire phosphor screen.

BRIEF SUMMARY OF THE INVENTION

The present invention has been made in consideration of the above problems and its object is to provide a cathode-ray tube apparatus capable of forming a beam spot with a good shape over the entire area of a phosphor screen.

According to a first aspect of the invention, there is provided a cathode-ray tube apparatus comprising: an electron gun assembly having an electron beam generating section which generates at least one electron beam, and a main electron lens section which focuses the electron beam emitted from the electron beam generating section on a phosphor screen; and a deflection yoke which produces deflection magnetic fields for deflecting the electron beam emitted from the electron gun assembly and causing the electron beam to horizontally and vertically scan the phosphor screen, wherein the electron gun assembly comprises a plurality of electrodes including a cathode supplied with a voltage of a relatively low first level, which constitute the electron beam generating section, at least one focus electrode supplied with a focus voltage of a second level higher than the first level, at least one dynamic focus electrode supplied with a dynamic focus voltage obtained by superimposing an AC component varying in synchronism with the deflection magnetic fields upon a reference voltage of a level close to the second level, and at least one anode supplied with an anode voltage of a third level higher than the second level, a first dynamic focus electrode supplied with the dynamic focus voltage is disposed adjacent to the electron beam generating section, and a first focus electrode supplied with the focus voltage is disposed adjacent to the first dynamic focus electrode, when the electron beam is deflected, a first electron lens section created between the electron beam generating section and the first dynamic focus electrode has a focusing function in horizontal and vertical directions, and a first asymmetrical lens section created between the first dynamic focus electrode and the first focus electrode has a relative diverging function in the horizontal direction and a relative focusing function in the vertical direction, and the first electron lens section and the first asymmetrical lens section are electrostatically coupled.

According to a second aspect of the invention, there is provided a cathode-ray tube apparatus comprising: an electron gun assembly having an electron beam generating section which generates an electron beam, and a main electron lens section which focuses the electron beam emitted from the electron beam generating section on a target; and a deflection yoke which produces deflection magnetic fields for horizontally and vertically deflecting the electron beam emitted from the electron gun assembly, wherein the electron gun assembly comprises a plurality of electrodes including a cathode supplied with a voltage of a relatively low first level, which constitute the electron beam generating section, at least one focus electrode supplied with a focus voltage of a second level higher than the first level, at least one dynamic focus electrode supplied with a dynamic focus voltage obtained by superimposing an AC component varying in synchronism with the deflection magnetic fields upon a reference voltage of a level close to the second level, at least one anode supplied with an anode voltage of a third level higher than the second level, and an insulating support member for supporting and fixing these electrodes, a first dynamic focus electrode supplied with the dynamic focus voltage is disposed adjacent to the electron beam generating section, and a first focus electrode supplied with the focus voltage is disposed adjacent to the first dynamic focus electrode, and the thickness of a peripheral portion of an electron beam passage hole formed in the first dynamic focus electrode for passing the electron beam emitted from the electron beam generating section is smaller than the thickness of the other part of the first dynamic focus electrode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGS. 12A and 12B show examples of the structure for enhancing the lens sensitivity of a quadrupole lens;

FIGS. 13A and 13B show examples of the electrode structure for correcting aberration of side beams;

DETAILED DESCRIPTION OF THE INVENTION

A cathode-ray tube (CRT) apparatus according to an embodiment of the present invention will now be described with reference to the accompanying drawings.

Figure 1:
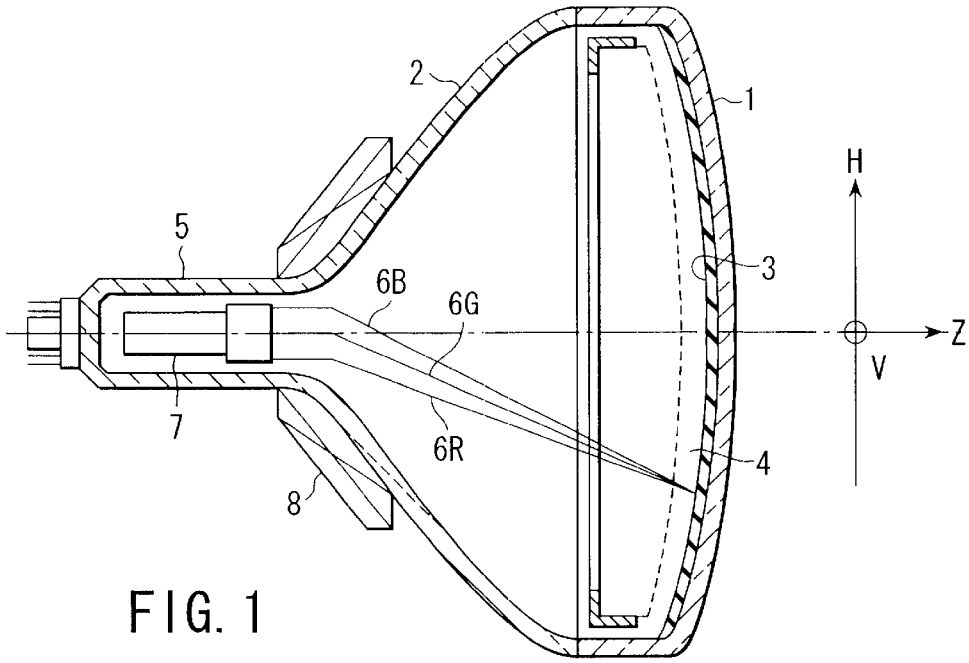
FIG. 1 is a horizontal cross-sectional view schematically showing the structure of a cathode-ray tube (CRT) apparatus according to an embodiment of the present invention.

As is shown in FIG. 1, a CRT apparatus of the present invention, e.g. a color cathode-ray tube apparatus, has a vacuum envelope 9. The vacuum envelope 9 has a panel 1 and a funnel 2 integrally coupled to the panel 1. The panel 1 has, on its inner surface, a phosphor screen 3 (target) having stripe-shaped or dot-shaped three-color phosphor layers which emit blue, green and red light, respectively. A shadow mask 4 is disposed to face the phosphor screen 3. The shadow mask 4 has many apertures in its inner part.

An in-line electron gun assembly 7 is disposed within a neck 5, which corresponds to a small-diameter portion of the funnel 2. The in-line electron gun assembly 7 emits three electron beams 6B, 6G and 6R in a tube axis direction Z. The three electron beams emitted from the electron gun assembly 7 comprise a center beam 6G and a pair of side beams 6B and 6R arranged in line in the same plane in a horizontal direction H. In this in-line electron gun assembly 7, a low-voltage grid and a high-voltage grid, which constitute a main electron lens section, have side beam passage holes, and the centers of these holes are decentered from each other. Thereby, the three electron beams are self-converged at a center area of the phosphor screen 3.

A deflection yoke 8 is provided on the outside of the funnel 9 at a region extending from the neck 5 to a large-diameter portion of the funnel 2. The deflection yoke 8 produces non-uniform deflection magnetic fields for deflecting the three electron beams 6B, 6G and 6R emitted from the electron gun assembly 7. The non-uniform deflection magnetic fields comprise a pincushion-shaped horizontal deflection magnetic field and a barrel-shaped vertical deflection magnetic field.

The three electron beams 6B, 6G and 6R emitted from the electron gun assembly 7 are focused on the associated phosphor layers of the phosphor screen 3, while being self-converged toward the phosphor screen 3. The three electron beams 6B, 6G and 6R are deflected by the non-uniform deflection magnetic fields and scan the phosphor screen 3 in the horizontal direction H and vertical direction V. Thereby, a color image is displayed.

Figure 2:
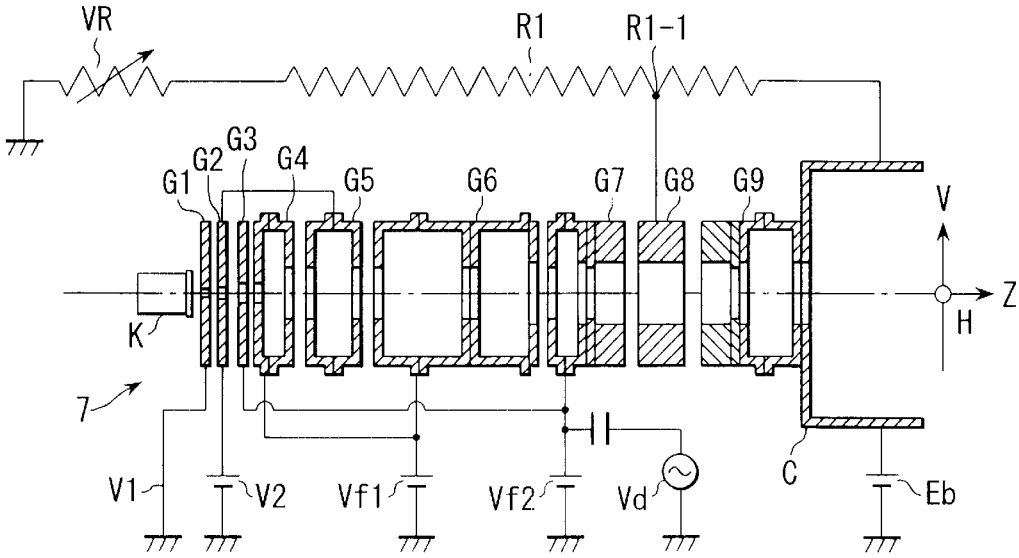
FIG. 2 is a vertical cross-sectional view schematically showing the structure of an electron gun assembly according to a first embodiment applicable to the CRT apparatus shown in FIG. 1.

As is shown in FIG. 2, the electron gun assembly 7 applied to this CRT apparatus comprises three cathodes K, a first grid G1, a second grid G2, a third grid G3 (first dynamic focus electrode), a fourth grid G4 (first focus electrode), a fifth grid G5, a sixth grid G6 (second focus electrode), a seventh grid G7 (second dynamic focus electrode), an eighth grid G8 (intermediate electrode), a ninth grid G9 (anode), and a convergence cup C. The three cathodes K are horizontally arranged in line. The first to ninth grids are successively arranged in the direction of travel of electron beams from the cathodes K and are fixed by an insulating support members 21.

The convergence cup C is fixed to the ninth grid G9 by welding. The convergence cup C is equipped with four contacts for electrical connection with an internal conductor film coated on the area extending from the inner surface of funnel 2 to the inner surface of neck 5.

The three cathodes K (R, G, B) are supplied with a voltage of about 100V to 200V. The first grid G1 is grounded (or supplied with a negative potential V1). The second grid G2 and fifth grid G5 are connected within the tube and supplied with a low acceleration voltage V2 from the outside of the CRT. This acceleration voltage V2 is about 500V to 800V.

The third grid G3 and seventh grid G7 are connected within the tube and supplied with a dynamic focus voltage (Vf2+Vd) from the outside of the CRT. The dynamic focus voltage (Vf2+Vd) is obtained by superimposing an AC component Vd varying in synchronism with the deflection magnetic fields upon a reference voltage, which is an intermediate-level second focus voltage Vf2 of about 6 to 8 kV (i.e. a voltage of about 25% of an anode voltage Eb mentioned below).

The fourth grid G4 and sixth grid G6 are connected within the tube and supplied with a fixed intermediate-level first focus voltage Vf1 from the outside of the CRT. The first focus voltage Vf1 is substantially equal to the second focus voltage Vf2 and is about 6 to 8 kV (i.e. a voltage of about 25% of an anode voltage Eb mentioned below).

The ninth grid G9 and convergence cup C are electrically connected and supplied with an anode voltage Eb from the outside of the CRT. The anode voltage Eb is about 25 kV to 35 kV.

As is shown in FIG. 2, a resistor R1 is provided near the electron gun assembly 7. One end of the resistor R1 is connected to the ninth grid G9, and the other end thereof is grounded via a variable resistor VR on the outside of the tube (or may be grounded directly without intervention of a variable resistor). The resistor R1 has, at its substantially middle part, a voltage supply terminal R1-1 for supplying a voltage to a grid of the electron gun assembly 7.

The eighth grid G8 is connected to the voltage supply terminal R1-1 of resistor R1. The eighth grid G8 is configured to be supplied with a voltage obtained by resistor-dividing the anode voltage Eb via the voltage supply terminal R1-1, e.g. a voltage of about 65% of the anode voltage Eb.

(First Embodiment)

The first grid G1 is a thin plate-shaped electrode. The first grid G1 has, in its plate face, three small-diameter electron beam passage holes (e.g. circular holes with a diameter of about 0.30 to 0.40 mm, or vertically or horizontally elongated rectangular holes) in association with the three cathodes K horizontally arranged in line.

Figure 3:
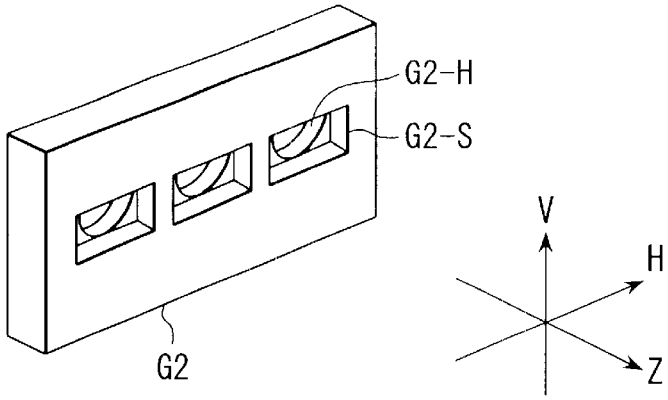
FIG. 3 is a perspective view schematically showing the structure of a second grid in the electron gun assembly shown in FIG. 2.

The second grid G2 is a plate-shaped electrode, as shown in FIG. 3. The second grid G2 has, in its plate face, three electron beam passage holes G2-H with a diameter slightly greater than that of each hole in the first grid G1 (e.g. circular holes with a diameter of about 0.35 to 0.45 mm) in association with the three cathodes K. The ratio of an electron beam passage hole diameter ΦG1 of the first grid G1 to an electron beam passage hole diameter ΦG2 of the second grid G2 is generally set at $70\% \leqq \Phi G1/\Phi G2 \leqq 100\%$. Alternatively, it may be set at about 75% or 90% depending on conditions. In addition, the second grid G2 has, in its face opposed to the third grid G3, slit-like recesses G2-S with horizontal longer axes in association with the electron beam passage holes G2-H. A shorter-axis dimension, i.e. a vertical dimension, of the recess G2-S is substantially equal to, or slightly greater than, the diameter of the electron beam passage hole G2-H. In this embodiment, the second grid G2 has circular electron beam passage holes G2-H and slit-like recesses G2-S in the face opposed to the third grid G3. The structure of the second grid G2 is not limited to this. The second grid G2 may be provided with electron beam passage holes G2-H alone, without the provision of recesses G2-S.

Figure 4:
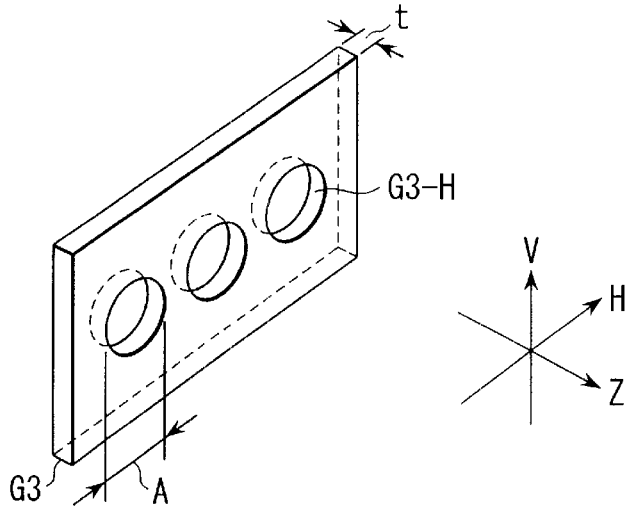
FIG. 4 is a perspective view schematically showing the structure of a third grid in the electron gun assembly shown in FIG. 2.

The third grid G3 is a thin plate-shaped electrode, as shown in FIG. 4. The thickness t of the third grid G3 is 0.2 to 1.0 mm. The third grid G3 has, in its plate face, three electron beam passage holes G3-H with a diameter still greater than that of each hole in the second grid G2 in association with the three cathodes K. For example, each electron beam passage hole G3-H is circular, and its diameter A is about 0.5 to 1.5 mm.

Figure 5:
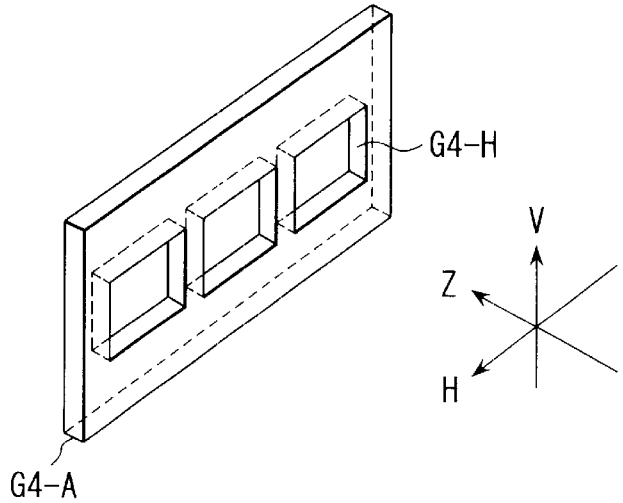
FIG. 5 is a perspective view schematically showing the structure of an electrode of a fourth grid, which is disposed on that face of the fourth grid opposed to the third grid in the electron gun assembly shown in FIG. 2.

The fourth grid G4 is formed by abutting open ends of two cup-shaped electrodes extending in the tube axis direction Z. As is shown in FIG. 5, the cup-shaped electrode G4-A opposed to the third grid G3 has, in its plate face, three electron beam passage holes G4-H (e.g. horizontally elongated rectangular holes with a vertical dimension of about 0.5 to 1.5 mm and a horizontal dimension of about 2.0 to 4.1 mm) in association with the three cathodes K.

Each electron beam passage hole G4-H has such a horizontally elongated rectangular shape that a shorter-axis dimension thereof, i.e. a vertical dimension, is substantially equal to (or less than) the diameter A of the electron beam passage hole G3-H of the third grid G3, and a horizontal dimension thereof is greater than the diameter A of the electron beam passage hole G3-H. The end face of the cup-shaped electrode opposed to the fifth grid G5 has three large-diameter electron beam passage holes (e.g. circular holes each with a diameter of about 3.0 to 4.1 mm) in association with the three cathodes K.

The fifth grid G5 is formed by abutting open ends of two cup-shaped electrodes extending in the tube axis direction Z. The end face of the cup-shaped electrode opposed to the fourth grid G4 has three large-diameter electron beam passage holes (e.g. circular holes each with a diameter of about 3.0 to 4.1 mm) in association with the three cathodes K. In addition, the end face of the cup-shaped electrode opposed to the sixth grid G6 has three large-diameter electron beam passage holes (e.g. circular holes each with a diameter of about 3.0 to 4.1 mm) in association with the three cathodes K.

The sixth grid G6 comprises three cup-shaped electrodes extending in the tube axis direction Z and a plate-shaped electrode. The open ends of two cup-shaped electrodes on the fifth grid G5 side are abutted on each other. The end faces of two cup-shaped electrodes on the seventh grid G7 side are abutted on each other. The open end of the cup-shaped electrode on the seventh grid G7 side is abutted on the thin plate-shaped electrode.

The end face of each of the three cup-shaped electrodes has three large-diameter electron beam passage holes (e.g. circular holes each with a diameter of about 3.0 to 4.1 mm) in association with the three cathodes K. The plate-shaped electrode opposed to the seventh grid G7 has, in its plate face, three vertically elongated electron beam passage holes (e.g. vertically elongated rectangular holes each with a ratio, i.e. horizontal dimension/vertical dimension about 4.0 mm/4.5 mm) in association with the three cathodes K.

The seventh grid G7 comprises two cup-shaped electrodes each with a small length in the tube axis direction Z and two plate-shaped electrodes. The open ends of the two cup-shaped electrodes on the sixth grid G6 side are abutted on each other. The end face of the cup-shaped electrode on the eighth grid G8 side is abutted on a thin plate-shaped electrode. This thin plate-shaped electrode is abutted on a thick plate-shaped electrode.

The end face of the cup-shaped electrode opposed to the sixth grid G6 has three horizontally (direction H) elongated electron beam passage holes (e.g. horizontally elongated rectangular holes each with a ratio, i.e. horizontal dimension/vertical dimension about 4.52 mm/3.0 mm) in association with the three cathodes K. The end face of the cup-shaped electrode opposed to the eighth grid G8 has three large-diameter electron beam passage holes (e.g. circular holes each with a diameter of about 4.34 mm) in association with the three cathodes K.

The thin plate-shaped electrode has, in its plate face, three horizontally (direction H) elongated electron beam passage holes (e.g. horizontally elongated rectangular holes each with a ratio, i.e. horizontal dimension/vertical dimension= about 4.34 mm/3.0 mm) in association with the three cathodes K. The thick plate-shaped electrode opposed to the eighth grid G8 has, in its plate face, three large-diameter electron beam passage holes (e.g. circular holes each with a diameter of about 4.34 mm) in association with the three cathodes K.

The eighth grid G8 comprises a thick plate-shaped electrode with a length of about 2.0 mm in the direction of travel of electron beams. This plate-shaped electrode has, in its plate face, three large-diameter electron beam passage holes (e.g. circular holes each with a diameter of about 4.40 mm) in association with the three cathodes K.

The ninth grid G9 comprises two plate-shaped electrodes and two cup-shaped electrodes. The thick plate-shaped electrode opposed to the eighth grid G8 is abutted on the thin plate-shaped electrode. The thin plate-shaped electrode is abutted on the end face of one of the cup-shaped electrodes. The open ends of the two cup-shaped electrodes are abutted on each other.

The thick plate-shaped electrode opposed to the eighth grid G8 has a length of about 0.6 mm to 1.5 mm in the direction of travel of electron beams. This plate-shaped electrode has, in its plate face, three large-diameter electron beam passage holes (e.g. circular holes each with a diameter of about 4.46 mm) in association with the three cathodes K. The thin plate-shaped electrode has, in its plate face, three horizontally (direction H) elongated electron beam passage holes (e.g. horizontally elongated rectangular holes each with a ratio, i.e. horizontal dimension/vertical dimension= about 4.46 mm/3.2 mm) in association with the three cathodes K. The end face of each of the two cup-shaped electrodes has three large-diameter electron beam passage holes (e.g. circular holes each with a diameter of about 4.46 to 4.52 mm) in association with the three cathodes K.

The convergence cup C has its end face abutted on the end face of the cup-shaped electrode of the ninth grid G9. The end face of the convergence cup C has three large-diameter electron beam passage holes (e.g. circular holes each with a diameter of about 4.46 to 4.52 mm).

In this electron gun assembly, each of the electrodes of the first grid G1 to sixth grid G6 has an inter-hole distance of, e.g. 4.92 mm, between the center of the electron beam passage hole for passing the center beam and the center of each of the electron beam passage holes for passing the side beams. The electrode of the seventh grid G7 opposed to the eighth grid G8 has an inter-hole distance of, e.g. 4.72 mm. The eighth grid G8 has an inter-hole distance of, e.g. 4.80 mm. The electrode of the ninth grid G9 opposed to the eighth grid G8 has an inter-hole distance of, e.g. 4.88 mm.

An inter-electrode distance between the sixth grid G6 and seventh grid G7, an inter-electrode distance between the seventh grid G7 and eighth grid G8 and an inter-electrode distance between the eighth grid G8 and ninth grid G9 are set at about 0.6 mm, respectively.

In the electron gun assembly with the above-described structure, an electron beam generating section is constituted by the cathodes K, first grid G1 and second grid G2. The electron beam generating section emits electron beams toward the phosphor screen. A prefocus lens (first electron lens section) PreL is constituted by the second grid G2 and third grid G3. The prefocus lens PreL prefocuses the electron beams emitted from the electron beam generating section.

A first quadrupole lens (first asymmetrical lens) QL1 is created between the third grid G3 and fourth grid G4. In a non-deflection mode in which an electron beam is focused on a center portion of the phosphor screen, the first quadrupole lens QL1 is configured such that a potential difference between the third grid G3 and fourth grid G4 is nearly zero, or the voltage of the third grid G3 is set to be lower than that of the fourth grid G4. Accordingly, no substantial lens function occurs, or a horizontal focusing lens function and a vertical diverging lens function are performed.

As the electron beam is deflected toward a peripheral portion of the phosphor screen, the third grid G3 is supplied with a dynamic focus voltage (Vf2+Vd) increasing in accordance with an increase in the deflection amount of the electron beam. Thus, the lens function of the first quadrupole lens QL1 varies such that a horizontal relative diverging function and a vertical relative focusing function are performed in accordance with the increase in the deflection amount of the electron beam.

A sub-lens is constituted by the fourth grid G4, fifth grid G5 and sixth grid G6. The sub-lens further prefocuses the already prefocused electron beam. This sub-lens is a unipotential electron lens formed by disposing the fifth grid G5, which is supplied with a relatively low voltage, between the fourth grid G4 and sixth grid G6, which are supplied with a focus voltage.

A main electron lens section is constituted by the sixth grid G6, seventh grid G7, eighth grid G8 and ninth grid G9. The main electron lens section ultimately focuses the electron beams, which have been prefocused by the sub-lens, on the phosphor screen. The main electron lens section comprises a second quadrupole lens (second asymmetrical lens) QL2, which is created between the sixth grid G6 and seventh grid G7, and a main lens section (second electron lens section) ML created by the seventh grid G7 and ninth grid G9.

In the non-deflection mode, the second quadrupole lens (second asymmetrical lens) QL2 is configured such that a potential difference between the sixth grid G6 and seventh grid G7 is nearly zero, or the voltage of the seventh grid G7 is set to be lower than that of the sixth grid G6. Accordingly, no substantial lens function occurs, or a horizontal diverging lens function and a vertical focusing lens function are performed. In this case, the seventh grid G7 is supplied with the dynamic focus voltage (Vf2+Vd) increasing in accordance with an increase in the deflection amount of the electron beam. Thus, the lens function of the second quadrupole lens QL2 varies such that a horizontal relative focusing function and a vertical relative diverging function are performed in accordance with the increase in the deflection amount of the electron beam.

The main lens section ML has substantially equal focusing functions relatively in the horizontal and vertical directions. The main lens section ML varies such that its lens power decreases as the deflection amount of the electron beam increases.

Figure 6A:
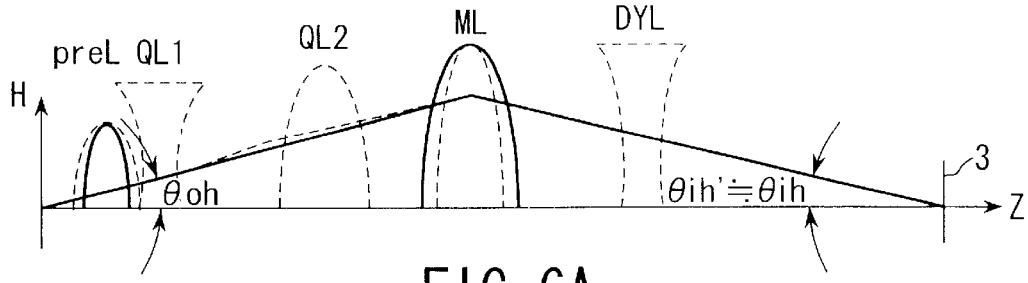
FIG. 6A shows an optical model for illustrating a horizontal lens function acting on an electron beam in the electron gun assembly shown in FIG. 2.
Figure 6B:
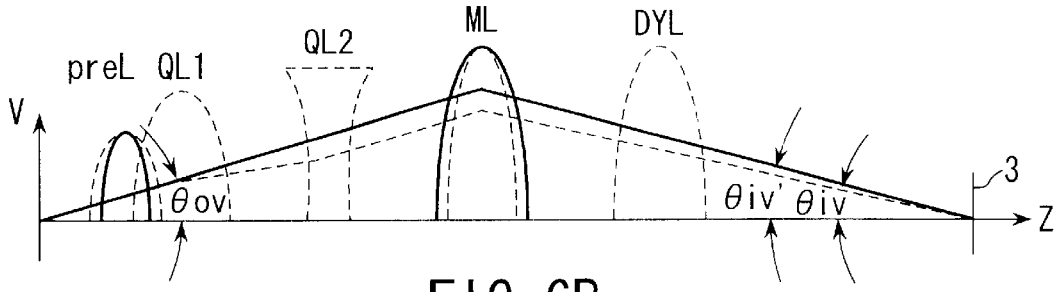
FIG. 6B shows an optical model for illustrating a vertical lens function acting on an electron beam in the electron gun assembly shown in FIG. 2

In the electron gun assembly with the above-described structure, as shown in FIGS. 6A and 6B, the prefocus lens (first electron lens) (second grid G2–third grid G3) PreL is disposed adjacent to the electron beam generating section (cathodes K–second grid G2), and the first quadrupole lens (third grid G3–fourth grid G4) QL1 is disposed adjacent to the prefocus lens (first electron lens) PreL. The prefocus lens (first electron lens) PreL and first quadrupole lens QL1 are electrostatically coupled by fully reducing the thickness of the third grid G3.

In FIGS. 6A and 6B, solid lines indicate an optical model in a non-deflection mode in which an electron beam is focused on a center portion of the phosphor screen. Broken lines indicate an optical model in a deflection mode in which an electron beam is deflected onto a peripheral portion of the phosphor screen. Symbol PreL denotes the prefocus lens, QL1 the first quadrupole lens, QL2 the second quadrupole lens, ML the main lens section, and DYL a deflection aberration component of deflection magnetic fields.

The third grid G3 shared by the prefocus lens PreL and first quadrupole lens QL1 is constructed to meet the relationship:

$$(A-t) \geqq (L/2)$$

where t is the electrode thickness, i.e. the thickness of the electrode of the third grid G3 in the direction of travel of the electron beam (tube axis direction Z), A is the hole diameter of the electron beam passage hole G3-H in the third grid G3, as viewed from the second grid side, and L is the inter-electrode distance between the third grid G3 and fourth grid G4, which form the first quadrupole lens QL1.

Specifically, the center (L/2) of the first quadrupole lens QL1 created between the third grid G3 and fourth grid G4 is positioned within the electric field (A–t) which is produced by the prefocus lens PreL created by a relatively large potential difference between the second grid G2 and third grid G3 and permeates via the electron beam passage holes in the third grid G3.

By virtue of this structure, an unnecessary increase in the dynamic focus voltage can be prevented when the dynamic focus voltage is applied to the third grid G3.

Specifically, the first electron lens section (prefocus lens section) (PreL), which is created by the second grid G2 and third grid G3 and performs focusing functions in the horizontal/vertical direction upon application of the dynamic focus voltage, and the first asymmetrical lens (QL1) created between the third grid G3 and fourth grid G4 are electrostatically coupled in operation. Thus, the first asymmetrical lens (QL1) functions as part of the first electron lens section (PreL) such that it merely varies the polarity of the first electron lens section (PreL). Accordingly, unlike the conventional double-quadrupole lens operation, an imaginary object point does not shift back to the cathode side due to the creation of a symmetric lens which is a synthetic lens function of the first and second quadrupole lens in the space where it has not existed. Moreover, no increase in dynamic focus voltage occurs.

Since the prefocus lens PreL electrostatically coupled to the first quadrupole lens QL1 is disposed adjacent to the electron beam generating section, the opening size of each electrode (the third grid G3 and the third grid side cup-shaped electrode of the fourth grid G4) forming the first quadrupole lens QL1 can be decreased to such a degree that electron beams do not collide. Thus, the sensitivity of the first quadrupole lens QL1 can be enhanced.

Unlike the conventional double-quadrupole lens structure, there is no need to provide upright projections extending in the direction of travel of electron beams, and a variance in precision can be avoided.

The diameter of each electron beam passage hole in the third grid G3 is made substantially equal to the shorter-axis dimension (vertical dimension) of each electron beam passage hole in the cup-shaped electrode of the fourth grid G4, which is situated on the third grid G3 side. Thus, when the lens function of the first quadrupole lens QL1 varies in synchronism with the deflection magnetic fields, the synthetic lens function of the prefocus lens PreL and first quadrupole lens QL1 behaves such that a vertical focusing function increasing in accordance with the increase in the deflection amount of the electron beam is performed, and a horizontal lens function, which does not substantially vary, compared to the vertical lens function, is performed.

The reason for this is that, as is shown in FIGS. 6A and 6B, in the deflection mode, the horizontal focusing function of the prefocus lens PreL is intensified in accordance with the increase in the deflection amount of the electron beam, as indicated by the broken lines. The first quadrupole lens QL1 having the horizontal diverging function is created so as to cancel the intensified focusing function.

On the other hand, in the deflection mode, the vertical focusing function of the prefocus lens PreL is intensified in accordance with the increase in the deflection amount of the electron beam, as indicated by the broken lines. At the same time, the first quadrupole lens QL1 having the vertical focusing function is created. Thereby, as regards the vertical direction, the intensity of the focusing function of the prefocus lens PreL is further increased by the focusing function of the first quadrupole lens QL1 in the deflection mode.

As has been described above, according to the first embodiment, when the dynamic focus voltage is applied, the horizontal divergence angle is not substantially varied, and only the vertical focusing is effected. Thus, in the horizontal direction it is possible to prevent an increase in divergence angle prior to the incidence of the electron beam on the main lens section ML. The electron beam is not affected by the lens aberration of the main lens section ML, and a beam spot with a good shape can be formed over the entire phosphor screen.

The present invention is not limited to the above-described first embodiment.

(Modification 1)

In the first embodiment, for example, one of the electrodes of the main electron lens section is supplied with a voltage divided by the resistor. Alternatively, two of the electrodes may be supplied with a resistor-divided voltage. As is well known, an aberration which possibly occurs to deform the cross section of the side beam in a triangular shape can be compensated by disposing a thin plate-shaped electrode having triangular electron beam passage holes, as shown in FIGS. 13A and 13B, on the phosphor screen side of the thick plate-shaped electrode of the ultimate acceleration electrodes.

(Modification 2)

Figure 8:
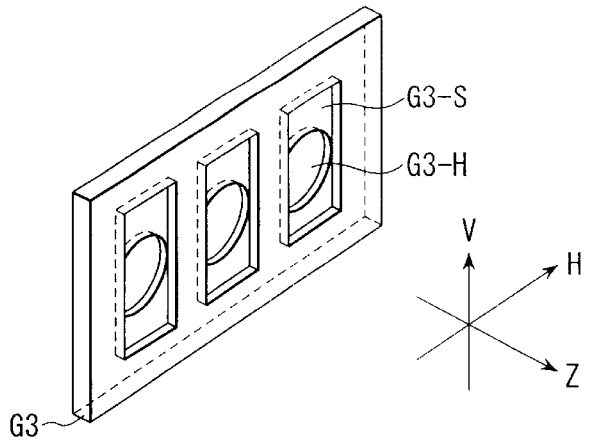
FIG. 8 is a perspective view schematically showing another structure of the third grid in the electron gun assembly shown in FIG. 2.
Figure 9A:
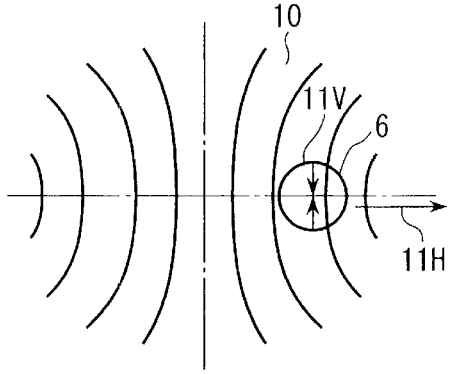
FIG. 9A (PRIOR ART)
FIG. 9A shows a state in which a pincushion-shaped horizontal deflection magnetic field produced by a deflection yoke acts on an electron beam.
Figure 9B:
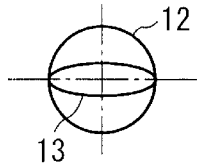
FIG. 9B (PRIOR ART)
FIG. 9B shows a beam spot of an electron beam deflected onto a peripheral portion of a phosphor screen.
Figure 10A:
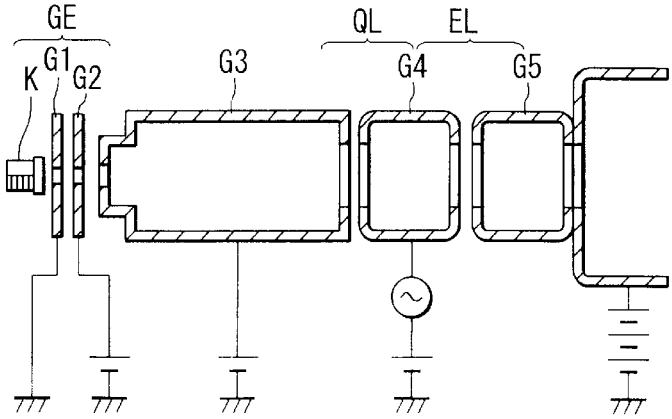
FIG. 10A (PRIOR ART)
FIG. 10A schematically shows the structure of a conventional electron gun assembly.
Figure 10B:
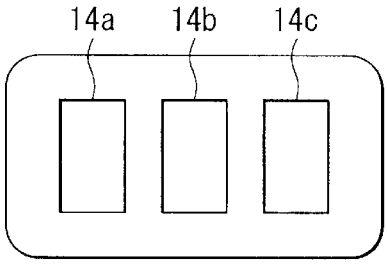
FIG. 10B (PRIOR ART)
FIGS. 10B and 10C show the shapes of electron beam passage holes for creating a quadrupole lens in the conventional electron gun assembly.
Figure 10C:
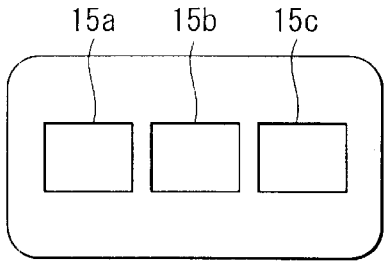
FIG. 10C (PRIOR ART)
Figure 11A:
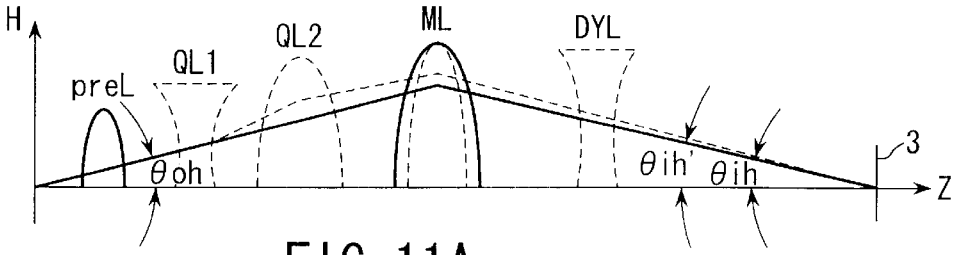
FIG. 11A (PRIOR ART)
FIG. 11A shows an optical model for illustrating a horizontal lens function in an electron gun assembly with a conventional double-quadrupole lens structure.
Figure 11B:
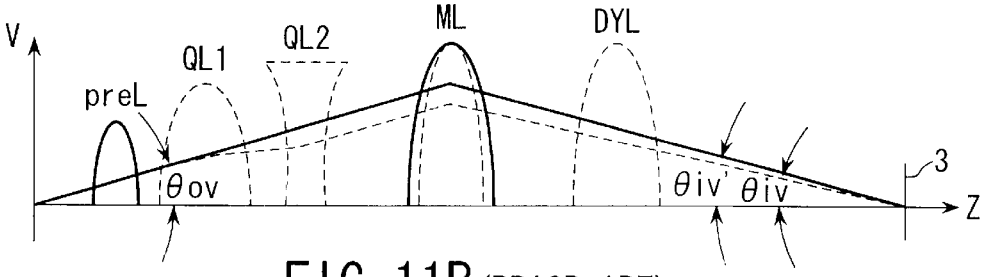
FIG. 11B (PRIOR ART)
FIG. 11B shows an optical model for illustrating a vertical lens function.
Figure 11C:
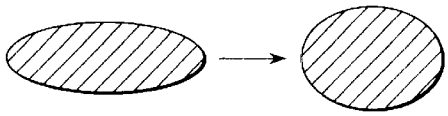
FIG. 11C (PRIOR ART)
FIG. 11C shows a beam spot created by the conventional electron gun assembly, in comparison with a beam spot created by the electron gun assembly using conventional double-quadrupole lens structure.

In the first embodiment, the third grid G3 is formed to have the circular electron beam passage holes G3-H, as shown in FIG. 4. Alternatively, as shown in FIG. 8, the third grid G3 may be formed to have circular electron beam passage holes G3-H and vertically elongated slit-like recesses G3-S each having a horizontal longer axis, which are formed on that face of the third grid G3 opposed to the fourth grid G4 so as to surround the electron beam passage holes G3-H. Thereby, the lens sensitivity of the first quadrupole lens QL1, which is created between the third grid G3 and fourth grid G4, can be further enhanced.

(Modification 3)

In the first embodiment, the eighth grid G8, which is one of the grids of the main electron lens section and is supplied with a voltage from the resistor, has circular electron beam passage holes. The present invention, however, is not limited to this structure.

Figure 7:
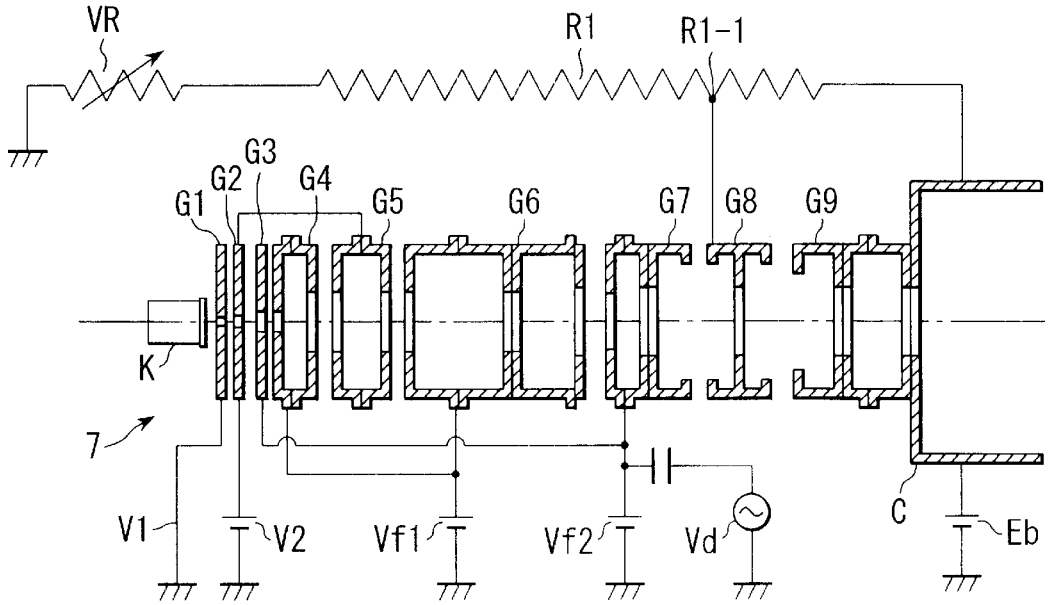
FIG. 7 is a vertical cross-sectional view schematically showing the structure of an electron gun assembly according to another embodiment applicable to the CRT apparatus shown in FIG. 1.

As is shown in FIG. 7, the main electron lens section may comprise a seventh grid (second dynamic focus electrode) G7 supplied with a dynamic focus voltage (Vf2+Vd), a ninth grid (anode) G9 supplied with an anode voltage Eb and an eighth grid (intermediate electrode) G8 disposed between the seventh grid G7 and ninth grid G9. In addition, electron beam passage holes for commonly passing three electron beams may be formed in that face of the dynamic focus electrode G7 opposed to the intermediate electrode G8, those faces of the intermediate electrode G8 opposed to both the dynamic focus electrode G7 and anode electrode G9, and that face of the anode electrode G9 opposed to the intermediate electrode G8. With this structure, too, the same advantages as with the first embodiment can be obtained.

(Modification 4)

The electron gun assembly applied to the first embodiment is a model to be sealed in the neck with a diameter of 22.5 mm (tolerance: ±0.7 mm). The electrode opening size is set at a small value. The invention is not limited to this structure. The invention is applicable to an electron gun assembly with an electrode opening size of about 5.5 to 6.2 mm, which is sealed in the neck with a diameter of 29.1 mm, or to other types of electron gun assemblies.

(Modification 5)

Figure 14:
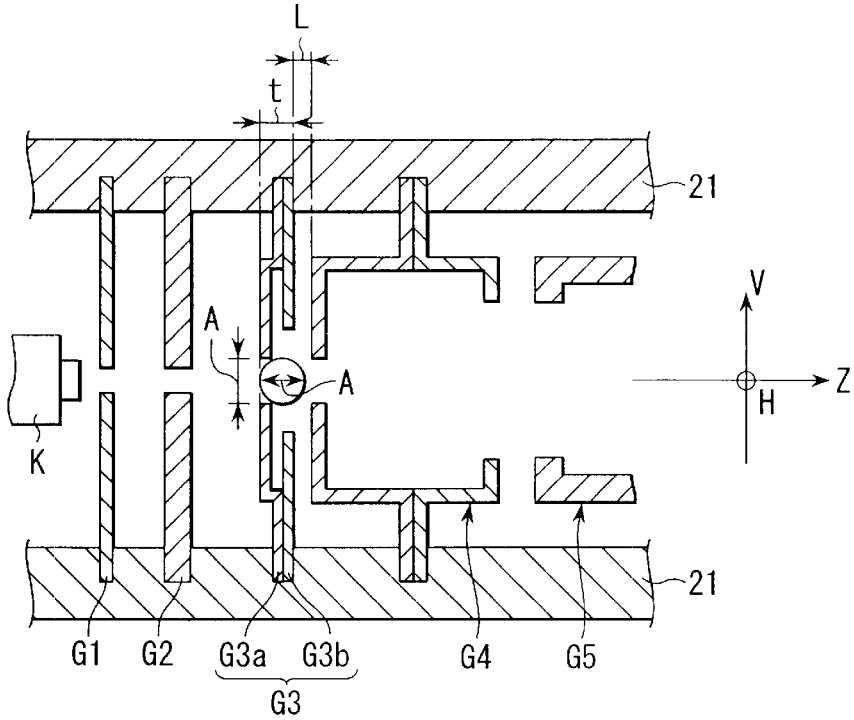
FIG. 14 is a vertical cross-sectional view schematically showing the structure including elements from a cathode to a fifth grid in an electron gun assembly according to a modification of the first embodiment.

In the first embodiment, the first dynamic focus electrode (third grid G3) comprises a plate-shaped electrode. However, the invention is not limited to this structure. For example, as shown in FIG. 14, the first dynamic focus electrode G3 may comprise a combination of a cup-shaped electrode G3*a* with a small wall thickness and a plate-shaped electrode G3*b*. Alternatively, the first dynamic focus electrode G3 may comprise a combination of a plurality of cup-shaped electrodes with a small wall thickness or a combination of a plurality of plate-shaped electrodes.

Figure 15:
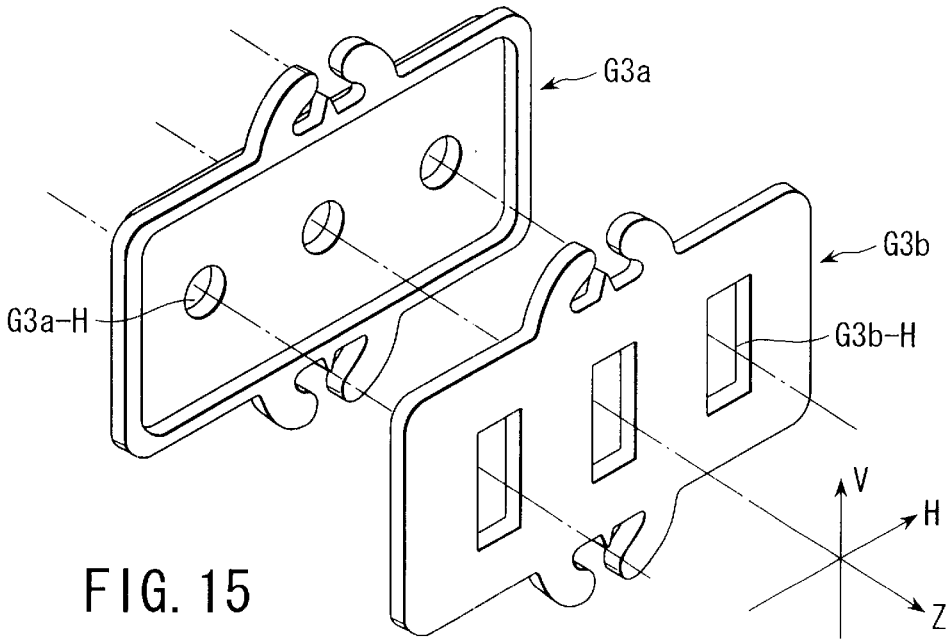
FIG. 15 is a perspective view schematically showing the structure of a third grid in the electron gun assembly shown in FIG. 14.

For example, as shown in FIG. 15, the first dynamic focus electrode G3 comprises a cup-shaped electrode G3*a* disposed on the electron beam generating section side and a plate-shaped electrode G3*b* disposed on the first focus electrode G4 side. The cup-shaped electrode G3*a* has substantially circular electron beam passage holes G3*a*-H. The plate-shaped electrode G3*b* has vertically elongated electron beam passage holes G3*b*-H each having a vertical longer axis.

With this structure, the lens sensitivity of the first quadrupole lens QL1 created between the third grid G3 and fourth grid G4 can be enhanced. Of course, the shape of each electron beam passage hole G3*b*-H of the plate-shaped electrode G3*b* disposed on the first focus electrode G4 side is not limited to a vertically elongated shape, and each electron beam passage hole G3*b*-H may be a large-diameter substantially circular electron beam passage hole.

Even where the third grid G3 comprises a combination of a plurality of electrodes, the prefocus lens PreL created between the second grid G2 and third grid G3 has an electron lens region extending through the electron beam passage holes G3*a*-H of cup-shaped electrode G3*a* toward the fourth grid G4. This electron lens region is created by an electric field that has permeated into the electron beam passage hole G3*a*-H by a distance corresponding to the electron beam passage hole diameter A. The first quadrupole lens QL1 created between the third grid G3 and fourth grid G4 is created in the electron lens region that has permeated to the fourth grid G4 side of prefocus lens PreL. In short, the prefocus lens PreL is electrostatically coupled to the first quadrupole lens QL1. Thus, the same advantages as with the first embodiment can be obtained.

As has been described above, according to the first embodiment and each modification, there is provided a cathode-ray tube apparatus wherein good focus characteristics can be obtained over the entire phosphor screen, and a beam spot with a good shape can be formed.

(Second Embodiment)

A second embodiment of the invention is directed to a structure of an electron gun assembly, which is applicable to the above-described CRT apparatus. The basic structure of the electron gun assembly and the voltages applied to the grids are the same as those in the first embodiment, and a detailed description thereof is omitted.

In the second embodiment, the third grid G3 with a small wall thickness, which is applied to the first embodiment, is reinforced.

In the electron gun assembly including the dynamic focus electrode supplied with the aforementioned dynamic focus voltage, the following problem may arise in operation. Specifically, a Noize sound may be produced due to a variation in coulomb force occurring between the dynamic focus electrode and an adjacent electrode when the dynamic focus voltage has been applied. The Noize sound results from mechanical vibration due to coulomb force between the dynamic focus electrode and adjacent electrode. The Noize sound is influenced by the holding force of the insulating support members which hold and fix the electrodes, the mechanical strength of the electrodes, etc. The possibility of occurrence of Noize sound increases as the distance between the dynamic focus electrode, which is a source of vibration, and the stems serving as voltage supply terminals becomes smaller, or the distance between the dynamic focus electrode and the heater serving as a heat source for the cathodes becomes smaller.

In order to improve the problem, it is necessary to increase the distance between the stems or heater and the dynamic focus electrode, to increase the support holding force with which the insulating support members support the dynamic focus electrode and its adjacent electrode, and to increase the mechanical strength of the electrode.

On the other hand, it is desirable that the thickness of that portion of the dynamic focus electrode, which is near the electron beam passage hole in the dynamic focus electrode, be small, as in the first embodiment. If the thickness of the dynamic focus electrode is decreased, the electrostatic coupling between the electron lenses created on both sides of the dynamic focus electrode can be strengthened. Accordingly, deformation of a beam spot on a peripheral portion of the phosphor screen can be effectively improved, and a rise in dynamic focus voltage can effectively be suppressed. However, if the thickness of the dynamic focus electrode is reduced, the aforementioned problem of Noize sound will occur.

As stated above, if the thickness of the dynamic focus electrode is decreased, deformation of a beam spot on a peripheral portion of the phosphor screen can be improved and a rise in dynamic focus voltage can be suppressed. However, if the thickness of the dynamic focus electrode is reduced, the problem of Noize sound will occur. On the other hand, if the thickness of the dynamic focus electrode is increased, the problem of Noize sound does not easily occur, but the beam spot on the peripheral portion of the phosphor screen is deformed and the dynamic focus voltage rises.

Figure 16:
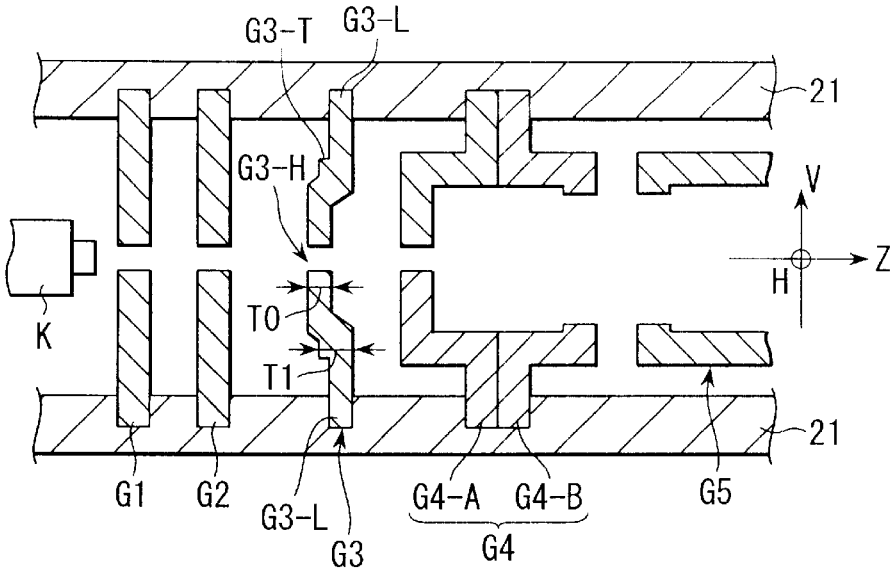
FIG. 16 is a vertical cross-sectional view schematically showing the structure including elements from a cathode to a fifth grid in an electron gun assembly according to a second embodiment applicable to the CRT apparatus shown in FIG. 1.

In the second embodiment, as shown in FIG. 16, the mechanical strength of the third grid G3, which functions as the first dynamic focus electrode disposed near the stems and heater, is increased. As is shown in FIG. 16, the cathodes K and the first grid G1 through fifth grid G5 are held by insulating support members 21. As regards the second embodiment, a description is omitted of the part of the fifth grid G5, sixth grid G6 through ninth grid G9 and convergence cup C.

The first grid G1 and second grid G2 have the same structures as in the first embodiment.

Figure 18:
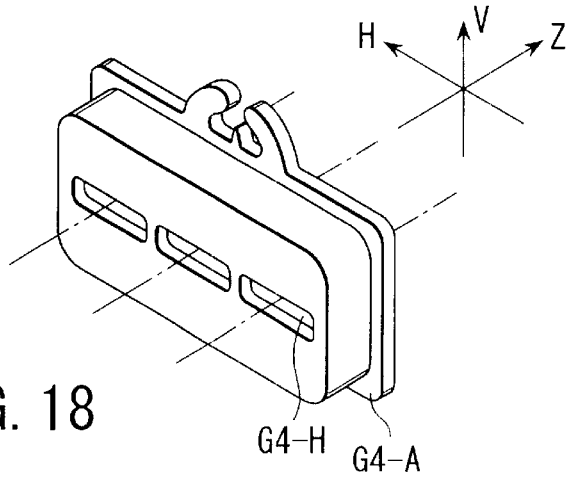
FIG. 18 is a perspective view schematically showing the structure of an electrode of a fourth grid, which is disposed on that face of the fourth grid opposed to the third grid in the electron gun assembly shown in FIG. 16.

The fourth grid G4 is formed by abutting open ends of two cup-shaped electrodes extending in the tube axis direction Z. As is shown in FIG. 18, the cup-shaped electrode G4-A opposed to the third grid G3 has, in its end face, three horizontally elongated electron beam passage holes G4-H (e.g. horizontally elongated rectangular holes with a vertical dimension of about 0.5 to 1.5 mm and a horizontal dimension of about 2.0 to 4.1 mm) in association with the three cathodes K.

Each electron beam passage hole G4-H has such a horizontally elongated rectangular shape that a vertical dimension thereof is substantially equal to (or less than) the diameter of the electron beam passage hole G3-H of the third grid G3, and a horizontal dimension thereof is greater than the diameter of the electron beam passage hole G3-H. The end face of the cup-shaped electrode G4-B opposed to the fifth grid G5 has three circular large-diameter electron beam passage holes (e.g. circular holes each with a diameter of about 3.0 to 4.1 mm) in association with the three cathodes K.

Figure 17:
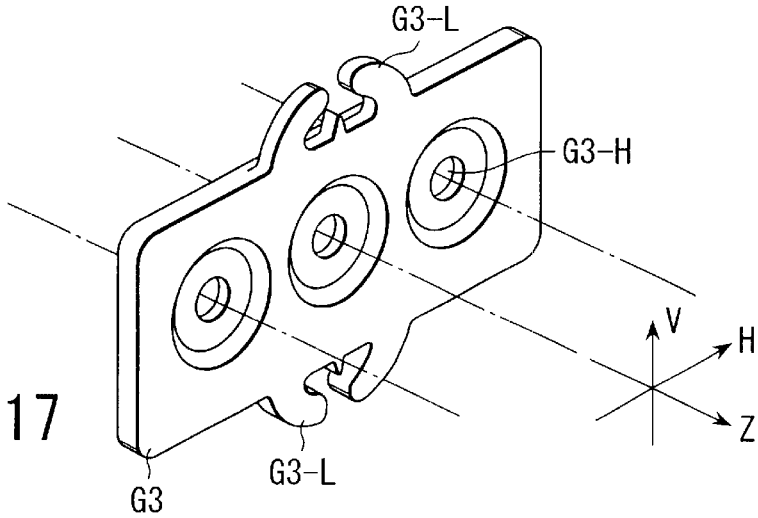
FIG. 17 is a perspective view schematically showing the structure of a third grid in the electron gun assembly shown in FIG. 16.

The third grid G3 has a shape as shown in FIGS. 16 and 17. Specifically, in the third grid G3, a peripheral portion of each electron beam passage hole G3-H is concentrically projected toward the second grid G2 of the electron beam generating section. The electron beam passage hole G3-H is formed at a substantial center of a circular portion corresponding to a recessed portion as viewed from the fourth grid G4 side.

A thickness T0 of the peripheral portion of the electron beam passage hole G3-H is less than a thickness T1 of other portions slightly remote from the electron beam passage hole G3-H, e.g. portions extending from the electron beam passage hole G3-H to engaging portions G3-L to be fixed to the insulating support members 21. In other words, the third grid G3 is formed to be thicker than the thickness T0 of the peripheral portion of the electron beam passage hole G3-H. For example, the third grid G3 has an electrode reinforcement portion, i.e. a concentric thick portion G3-T projected toward the second grid G2 along the peripheral edge of the electron beam passage hole G3-H, between the electron beam passage hole G3-H and the engaging portions G3-L. With this structure, the mechanical strength of the third grid G3 is increased.

Accordingly, even when the dynamic focus voltage (Vf2+Vd) has been applied to the third grid G3, mechanical vibration due to a variation in coulomb force between the third grid G3 and the electrodes on both sides thereof can be suppressed. By suppressing the vibration of the vibration source, the production of Noize sound from the electron gun assembly can be prevented.

The thickness T0 of the peripheral portion of the electron beam passage hole G3-H in the third grid G3 is reduced. Thereby, close electrostatic coupling can be achieved between the first electron lens PreL created by the second grid G2 and third grid G3 and the first asymmetrical lens QL1 created between the third grid G3 and fourth grid G4. Accordingly, as mentioned above, the first electron lens PreL and the first asymmetrical lens QL1 can be configured as if their lens functions were a single lens function. Moreover, it is possible to suppress local disturbance of an electric field due to the third grid G3 which is a boundary portion between the first electron lens PreL and the first asymmetrical lens QL1.

According to the second embodiment, the thickness of the peripheral portion of each electron beam passage hole in the first dynamic focus electrode is made less than the thickness of other portions of this electrode. When the dynamic focus voltage is applied to the first dynamic focus electrode, the first electron lens section having horizontal and vertical focusing functions is produced between the electron beam generating section and the adjacent first dynamic focus electrode. At the same time, the first asymmetrical lens section is formed between the first dynamic focus electrode and the first focus electrode. By reducing the thickness of the peripheral portion of the electron beam passage hole in the first dynamic focus electrode, close electrostatic coupling can be achieved between the two adjacent electron lenses created by the first dynamic focus electrode, i.e. the first electron lens and the first asymmetrical lens. Thereby, oval deformation of the beam spot on the peripheral portion on the phosphor screen can effectively be improved, and an increase in dynamic focus voltage can effectively be suppressed.

At the same time, according to the CRT apparatus, the thickness of those portions of the first dynamic focus electrode, which are other than the peripheral portion of each electron beam passage hole, is increased. Thus, even when a parabolic voltage component (AC component) of the dynamic focus voltage is applied to the first dynamic focus electrode, it is possible to suppress mechanical vibration of the first dynamic focus electrode due to coulomb force between this electrode and an adjacent electrode thereof. Besides, the recessed or projected electrode reinforcement portion is provided at the peripheral portion of each electron beam passage hole of the first dynamic focus electrode, or between the engaging portions to be fixed to the insulating support members and each electron beam passage hole. Thereby, mechanical vibration of the first dynamic focus electrode can be suppressed. Accordingly, production of Noize sound can effectively be suppressed.

The present invention is not limited to the above-described second embodiment.

(Modification 1)

Figure 19:
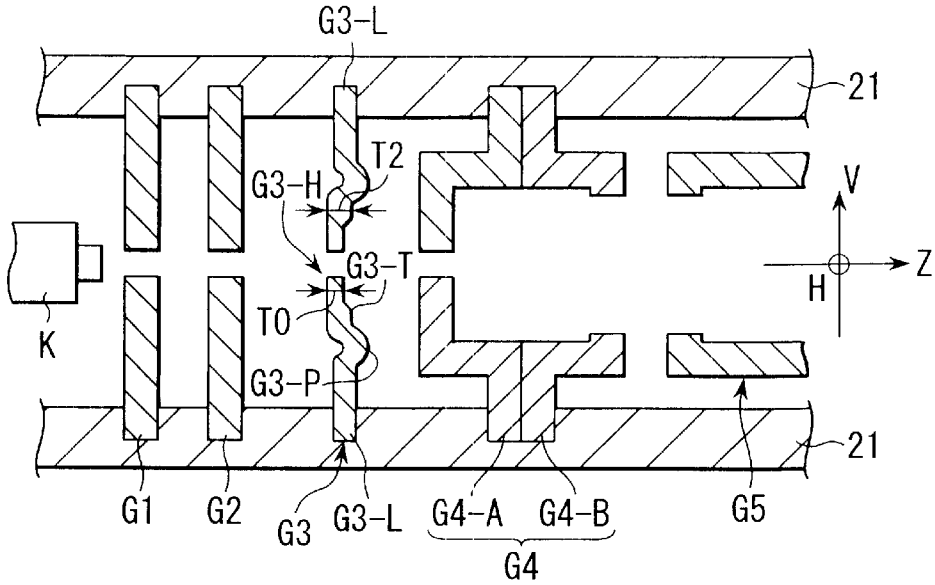
FIG. 19 is a vertical cross-sectional view schematically showing the structure including elements from a cathode to a fifth grid in another electron gun assembly according to the second embodiment.
Figure 20:
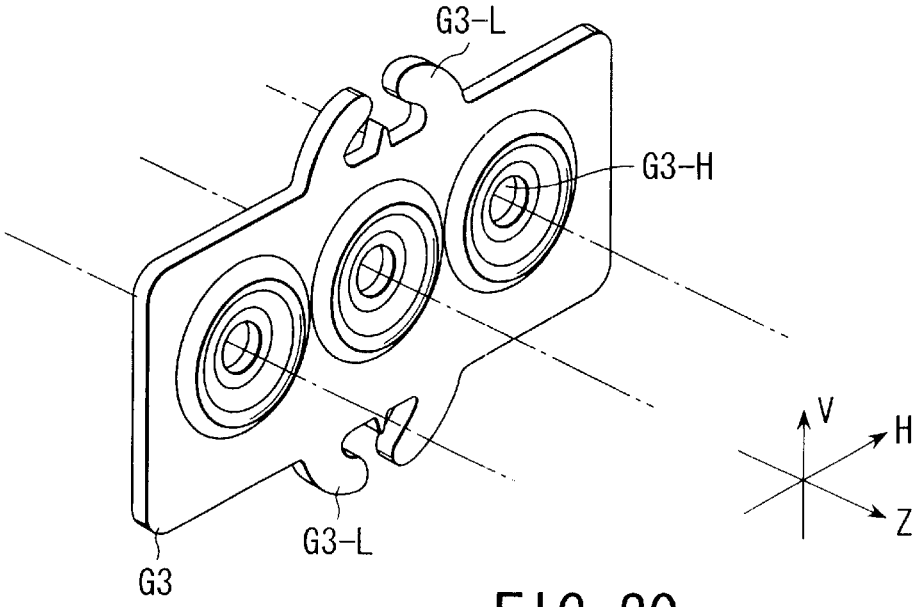
FIG. 20 is a perspective view schematically showing the structure of a third grid in the electron gun assembly shown in FIG. 19.

For example, the third grid (first dynamic focus electrode) G3 may have a structure as shown in FIGS. 19 and 20. As regards the third grid G3, the position of the electron beam passage hole G3-H coincides substantially with the position of the engaging portions G3-L in the tube axis direction Z.

A thickness T0 of the peripheral portion of the electron beam passage hole G3-H is less than a thickness T2 of other portions slightly remote from the electron beam passage hole G3-H, e.g. portions extending from the electron beam passage hole G3-H to engaging portions G3-L. In other words, the third grid G3 is formed to be thicker than the thickness T0 of the peripheral portion of the electron beam passage hole G3-H.

The third grid G3 has an electrode reinforcement portion, i.e. a concentric thick portion G3-T formed along the peripheral edge of the electron beam passage hole G3-H, between the electron beam passage hole G3-H and the engaging portions G3-L. In addition, the third grid G3 has an electrode reinforcement portion, i.e. a concentric projecting portion (concentric recessed portion as viewed from the second grid G2) G3-P projected toward the fourth grid (first focus electrode) G4 side at the peripheral portion of the thick portion G3-T. The electron beam passage hole G3-H is formed at a substantial center of a circular portion corresponding to a recessed portion as viewed from the fourth grid G4 side. With this structure of the third grid G3, the thickness of the peripheral portion of the electron beam passage hole G3-H can be reduced, and the mechanical strength of the third grid G3 can be increased.

An apex of the projecting portion G3-P is located near the fourth grid (first focus electrode) G4. Thereby, a coulomb force between the third grid G3 and fourth grid G4 acts mainly between the apex of the projecting portion G3-P of the third grid G3 and the fourth grid G4. On the other hand, the electron beam passage hole G3-H, which may cause vibration to the third grid G3 as a greatest point of force at a middle between both vertical support points (the engaging portions G3-L fixed to the insulating support members 21), is positioned away from the fourth grid G4. Thus, the coulomb force acting on the point of force is weakened. In this modification, in particular, it is possible to suppress mechanical vibration due to coulomb force produced when the dynamic focus voltage is applied to the third grid G3.

Accordingly, like the second embodiment, oval deformation of the beam spot on the peripheral portion on the phosphor screen can effectively be improved, and an increase in dynamic focus voltage can effectively be suppressed. Moreover, production of Noize sound can effectively be suppressed.

(Modification 2)

Figure 21:
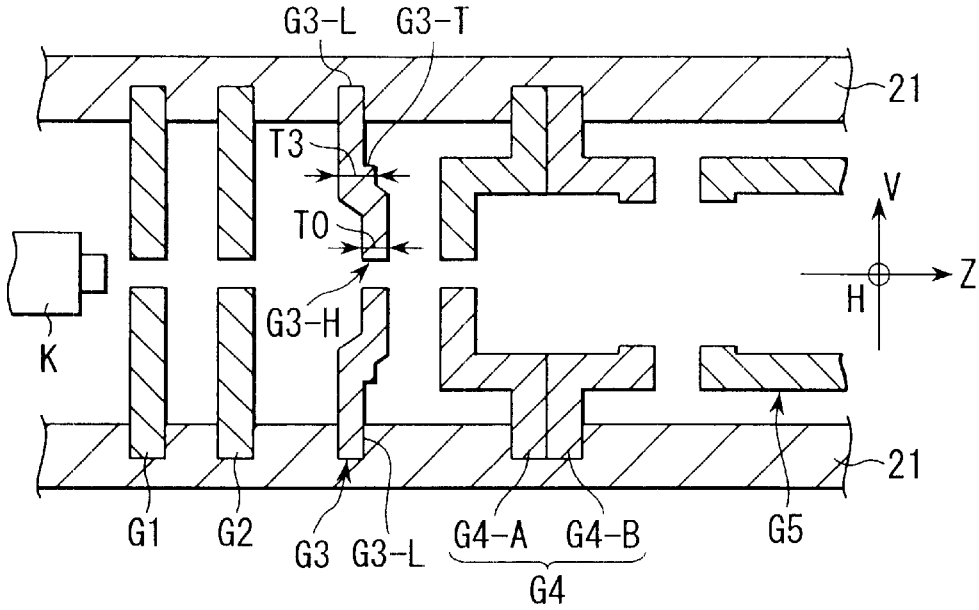
FIG. 21 is a vertical cross-sectional view schematically showing the structure including elements from a cathode to a fifth grid in another electron gun assembly according to the second embodiment.
Figure 22:
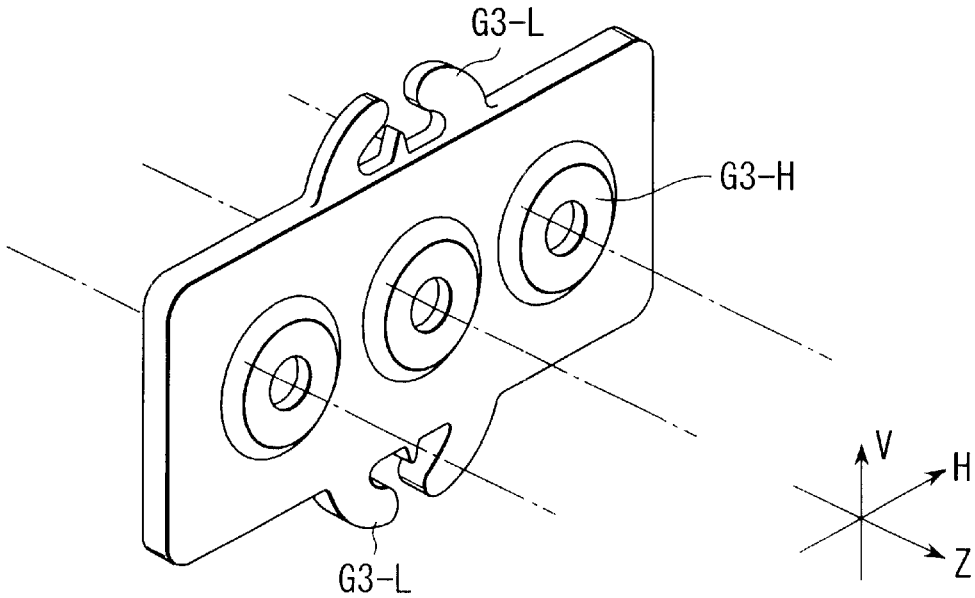
FIG. 22 is a perspective view schematically showing the structure of a third grid in the electron gun assembly shown in FIG. 21.

For example, the third grid (first dynamic focus electrode) G3 may have a structure as shown in FIGS. 21 and 22. As regards the third grid G3, the peripheral portion of the electron beam passage hole G3-H is concentrically projected toward the fourth grid G4 side. The electron beam passage hole G3-H is formed at a substantial center of a circular portion corresponding to a recessed portion as viewed from the second grid G2 side.

A thickness T0 of the peripheral portion of the electron beam passage hole G3-H is less than a thickness T3 of other portions slightly remote from the electron beam passage hole G3-H, e.g. portions extending from the electron beam passage hole G3-H to engaging portions G3-L. In other words, the third grid G3 is formed to be thicker than the thickness T0 of the peripheral portion of the electron beam passage hole G3-H. For example, the third grid G3 has an electrode reinforcement portion, i.e. a concentric thick portion G3-T formed to project toward the fourth grid G4 side along the peripheral edge of the electron beam passage hole G3-H, between the electron beam passage hole G3-H and the engaging portions G3-L. With this structure of the third grid G3, the thickness of the peripheral portion of the electron beam passage hole G3-H can be reduced, and the mechanical strength of the third grid G3 can be increased.

Moreover, according to this structure, the electron beam passage hole G3-H of third grid G3 can be positioned closer to the fourth grid G4. Thus, the lens function of the first asymmetrical lens QL1 created between the third grid G3 and fourth grid G4 can be further intensified. At the same time, the distance between the engaging portions G3-L of third grid G3 and the engaging portions G4-L of fourth grid G4 can be increased. Therefore, the breakdown voltage characteristics can be enhanced.

Accordingly, like the second embodiment, oval deformation of the beam spot on the peripheral portion on the phosphor screen can effectively be improved, and an increase in dynamic focus voltage can effectively be suppressed. Moreover, production of Noize sound can effectively be suppressed.

(Modification 3)

In the second embodiment, the eighth grid G8, which is one of the grids of the main electron lens section and is supplied with a voltage from the resistor, has circular electron beam passage holes. The present invention, however, is not limited to this structure. Like the first embodiment, even if the structure shown in FIG. 7 is adopted, the same advantages can be obtained.

(Modification 4)

Figure 23:
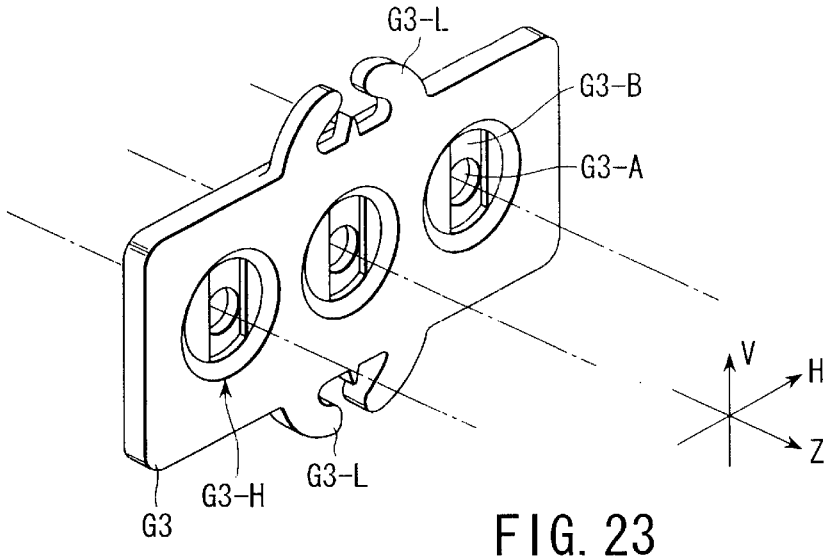
FIG. 23 is a perspective view schematically showing the structure of a third grid in another electron gun assembly according to the second embodiment.

In the second embodiment, the electron beam passage holes G3-H formed in the third grid G3 have simple circular shapes, as shown in FIG. 17. Alternatively, as shown in FIG. 23, each hole G3-H may be a combination of a circular opening portion G3-A and a vertically groove G3-B formed on the fourth grid side. With this structure, the lens function of the first asymmetrical lens (QL1) formed between the third grid G3 and fourth grid G4 can be further intensified.

(Modification 5)

Figure 24:
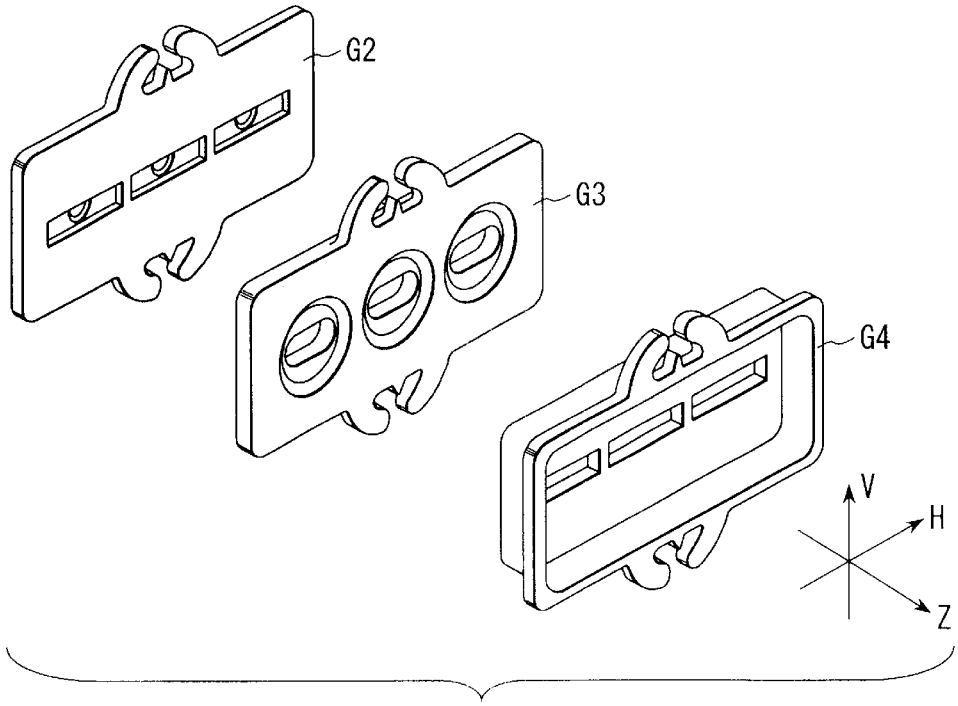
FIG. 24 is a perspective view schematically showing the structure including elements from a second grid to a fourth grid in an electron gun assembly according to a modification of the second embodiment.
Figure 25:
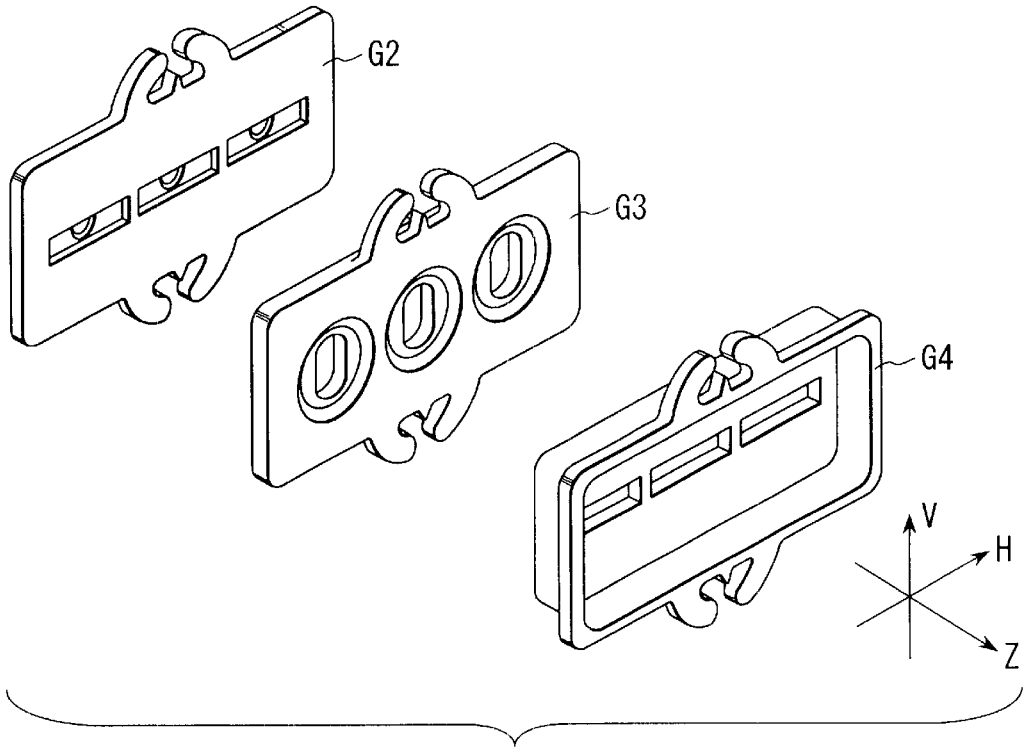
FIG. 25 is a perspective view schematically showing the structure including elements from a second grid to a fourth grid in an electron gun assembly according to a modification of the second embodiment.

In the second embodiment, the electron beam passage holes G3-H in the first dynamic focus electrode (third grid G3) have substantially circular shapes. The invention is not limited to this structure. For example, as shown in FIG. 24, each electron beam passage hole G3-H in the third grid G3 may have a horizontally elongated shape. Alternatively, as shown in FIG. 25, each electron beam passage hole G3-H in the third grid G3 may have a vertically elongated shape. Alternatively, each electron beam passage hole G3-H in the third grid G3 may have another shape. With this structure of the third grid G3, too, the same advantages as with the second embodiment can be obtained.

As has been described above, according to the second embodiment and each modification, there is provided a cathode-ray tube apparatus wherein a beam spot with a good shape can be formed over the entire phosphor screen and production of Noize sound from the electron gun assembly can be suppressed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube apparatus comprising:

an electron gun assembly having an electron beam generating section which generates at least one electron beam, and a main electron lens section which focuses the electron beam emitted from the electron beam generating section on a phosphor screen; and a deflection yoke which produces deflection magnetic fields for deflecting the electron beam emitted from the electron gun assembly and causing the electron beam to horizontally and vertically scan the phosphor screen, wherein the electron gun assembly comprises a plurality of electrodes including a cathode supplied with a voltage of a relatively low first level, which constitute the electron beam generating section, at least one focus electrode supplied with a focus voltage of a second level higher than the first level, at least one dynamic focus electrode supplied with a dynamic focus voltage obtained by superimposing an AC component varying in synchronism with the deflection magnetic fields upon a reference voltage of a level close to the second level, and at least one anode supplied with an anode voltage of a third level higher than the second level, a first dynamic focus electrode supplied with the dynamic focus voltage is disposed adjacent to the electron beam generating section, and a first focus electrode supplied with the focus voltage is disposed adjacent to the first dynamic focus electrode, when the electron beam is deflected, a first electron lens section created between the electron beam generating section and the first dynamic focus electrode has a focusing function in horizontal and vertical directions, and a first asymmetrical lens section created between the first dynamic focus electrode and the first focus electrode has a relative diverging function in the horizontal direction and a relative focusing function in the vertical direction, and the first electron lens section and the first asymmetrical lens section are electrostatically coupled.

2. The cathode-ray tube apparatus according to claim 1, wherein the following relationship is satisfied:

$$(A-t) \geqq (L/2)$$

wherein t is an electrode length of the first dynamic focus electrode,

A is a hole diameter of the electron beam passage hole in the first dynamic focus electrode, and L is a distance between the first dynamic focus electrode and the first focus electrode.

3. The cathode-ray tube apparatus according to claim 1, wherein said dynamic focus voltage is lower than the focus voltage in a non-deflection mode in which the electron beam is focused on a central portion of the screen, and varies such that a difference between the dynamic focus voltage and the focus voltage decreases in accordance with an increase in the deflection amount of the electron beam.

4. The cathode-ray tube apparatus according to claim 1, wherein a synthetic lens function of the first electron lens section and the first asymmetrical lens section behaves such that a vertical focusing function increasing in accordance with an increase in the deflection amount of the electron beam is performed, and a horizontal lens function, which does not substantially vary, compared to the vertical lens function, is performed.

5. The cathode-ray tube apparatus according to claim 4, wherein electron lens sections comprising an electrode, which constitutes a part of the electron beam generating section and is situated adjacent to the first dynamic focus electrode, the first dynamic focus electrode having a substantially circular electron beam passage hole, and the first focus electrode with an electron beam passage hole having a greater horizontal dimension than a vertical dimension, perform, when the electron lens sections are operated in synchronism with the deflection magnetic fields, such a synthetic lens function that a vertical focusing function increasing in accordance with an increase in the deflection amount of the electron beam is performed, and a horizontal lens function, which does not substantially vary, compared to the vertical lens function, is performed.

6. The cathode-ray tube apparatus according to claim 1, wherein the first dynamic focus electrode is a plate-shaped electrode having a substantially circular electron beam passage hole, and that face of the first focus electrode, which is opposed to the first dynamic focus electrode, is provided with asymmetrical lens forming means.

7. The cathode-ray tube apparatus according to claim 6, wherein said asymmetrical lens forming means is an electron beam passage hole having a greater horizontal dimension than a vertical dimension.

8. The cathode-ray tube apparatus according to claim 7, wherein the diameter of the electron beam passage hole formed in the first dynamic focus electrode is substantially equal to the vertical dimension of the electron beam passage hole formed in the first focus electrode.

9. The cathode-ray tube apparatus according to claim 1, wherein said main electron lens section comprises a second focus electrode supplied with the focus voltage, a second dynamic focus electrode supplied with the dynamic focus voltage, and said anode, and when the electron beam is deflected, a second asymmetrical lens section created between the second focus electrode and the second dynamic focus electrode has a relative focusing function in the horizontal direction and a relative diverging function in the vertical direction, and a second electron lens section created between the second dynamic focus electrode and the anode is configured to have at least a vertical lens function weakened in accordance with an increase in the deflection amount of the electron beam.

10. The cathode-ray tube apparatus according to claim 9, wherein said dynamic focus voltage is lower than the focus voltage in a non-deflection mode in which the electron beam is focused on a central portion of the screen, and varies such that a difference between the dynamic focus voltage and the focus voltage decreases in accordance with an increase in the deflection amount of the electron beam.

11. The cathode-ray tube apparatus according to claim 9, wherein at least one intermediate electrode is provided between the second dynamic focus electrode and the anode.

12. The cathode-ray tube apparatus according to claim 11, further comprising a resistor for supplying a voltage, which is obtained by resistor-dividing the anode voltage supplied to the anode, to said intermediate electrode.

13. The cathode-ray tube apparatus according to claim 9, wherein a uni-potential electron lens section created by a voltage different from the dynamic focus voltage and the focus voltage is provided between the first asymmetrical lens section and the second asymmetrical lens section.

14. The cathode-ray tube apparatus according to claim 13, wherein an electrode supplied with a voltage lower than the focus voltage is provided between the first focus electrode and the second focus electrode.

15. The cathode-ray tube apparatus according to claim 14, wherein the electrode supplied with the voltage lower than the focus voltage and provided between the first focus electrode and the second focus electrode is electrically connected to an electrode, which constitutes a part of the electron beam generating section and is situated adjacent to the first dynamic focus electrode.

16. A cathode-ray tube apparatus comprising:

an electron gun assembly having an electron beam generating section which generates an electron beam, and a main electron lens section which focuses the electron beam emitted from the electron beam generating section on a target; and a deflection yoke which produces deflection magnetic fields for horizontally and vertically deflecting the electron beam emitted from the electron gun assembly, wherein the electron gun assembly comprises a plurality of electrodes including a cathode supplied with a voltage of a relatively low first level, which constitute the electron beam generating section, at least one focus electrode supplied with a focus voltage of a second level higher than the first level, at least one dynamic focus electrode supplied with a dynamic focus voltage obtained by superimposing an AC component varying in synchronism with the deflection magnetic fields upon a reference voltage of a level close to the second level, at least one anode supplied with an anode voltage of a third level higher than the second level, and an insulating support member for supporting and fixing these electrodes, a first dynamic focus electrode supplied with the dynamic focus voltage is disposed adjacent to the electron beam generating section, and a first focus electrode supplied with the focus voltage is disposed adjacent to the first dynamic focus electrode, and the thickness of a peripheral portion of an electron beam passage hole formed in the first dynamic focus electrode for passing the electron beam emitted from the electron beam generating section is smaller than the thickness of the other part of the first dynamic focus electrode.

17. The cathode-ray tube apparatus according to claim 16, wherein the first dynamic focus electrode has a concentric projecting portion at a peripheral portion of the electron beam passage hole, the concentric projecting portion projecting toward the first focus electrode side, and the electron beam passage hole is formed at a substantial center of a region corresponding to a recessed portion as viewed from the first focus electrode side.

18. The cathode-ray tube apparatus according to claim 16, wherein the first dynamic focus electrode has a substantially circular electron beam passage hole, and the first focus electrode has, in its side facing the first dynamic focus electrode, a horizontally elongated electron beam passage hole having a greater horizontal dimension than a vertical dimension and having a vertical dimension substantially equal to, or less than, the diameter of the electron beam passage hole in the first dynamic focus electrode, and an asymmetrical lens acting in synchronism with the deflection magnetic fields is formed between the first dynamic focus electrode and the first focus electrode.

19. The cathode-ray tube apparatus according to claim 16, wherein when the electron beam is deflected, a first electron lens section created between the electron beam generating section and the first dynamic focus electrode has a focusing function in horizontal and vertical directions, and a first asymmetrical lens section created between the first dynamic focus electrode and the first focus electrode has a relative diverging function in the horizontal direction and a relative focusing function in the vertical direction, and the first electron lens section and the first asymmetrical lens section are electrostatically coupled.

20. The cathode-ray tube apparatus according to claim 19, wherein a synthetic lens function of the first electron lens section and the first asymmetrical lens section behaves such that a vertical focusing function increasing in accordance with an increase in the deflection amount of the electron beam is performed, and a horizontal lens function, which does not substantially vary, compared to the vertical lens function is performed.

21. The cathode-ray tube apparatus according to claim 19, wherein said main electron lens section comprises a second focus electrode supplied with the focus voltage, a second dynamic focus electrode supplied with the dynamic focus voltage, and said anode, and when the electron beam is deflected, a second asymmetrical lens section created between the second focus electrode and the second dynamic focus electrode has a relative focusing function in the horizontal direction and a relative diverging function in the vertical direction, and a second electron lens section created between the second dynamic focus electrode and the anode is configured to have at least a vertical lens function weakened in accordance with an increase in the deflection amount of the electron beam.

22. The cathode-ray tube apparatus according to claim 21, wherein a uni-potential electron lens section containing a voltage different from the focus voltage and the dynamic focus voltage is provided between the first asymmetrical lens section and the second asymmetrical lens section.

23. A cathode-ray tube apparatus comprising:

an electron gun assembly having an electron beam generating section which generates an electron beam, and a main electron lens section which focuses the electron beam emitted from the electron beam generating section on a target; and a deflection yoke which produces deflection magnetic fields for horizontally and vertically deflecting the electron beam emitted from the electron gun assembly, wherein the electron gun assembly comprises a plurality of electrodes including a cathode supplied with a voltage of a relatively low first level, which constitute the electron beam generating section, at least one focus electrode supplied with a focus voltage of a second level higher than the first level, at least one dynamic focus electrode supplied with a dynamic focus voltage obtained by superimposing an AC component varying in synchronism with the deflection magnetic fields upon a reference voltage of a level close to the second level, at least one anode supplied with an anode voltage of a third level higher than the second level, and an insulating support member for supporting and fixing these electrodes, a first dynamic focus electrode supplied with the dynamic focus voltage is disposed adjacent to the electron beam generating section, and a first focus electrode supplied with the focus voltage is disposed adjacent to the first dynamic focus electrode, the thickness of a peripheral portion of an electron beam passage hole formed in the first dynamic focus electrode for passing the electron beam emitted from the electron beam generating section is smaller than the thickness of the other part of the first dynamic focus electrode, and wherein the first dynamic focus electrode has electrode reinforcement means comprising a recessed portion or a projecting portion at a region between the electron beam passage hole and an engaging portion to be fixed to the insulating support member.

* * * * *